US005873748A

United States Patent [19]

Getselis et al.

[11] Patent Number: 5,873,748

[45] **Date of Patent: *Feb. 23, 1999**

[54] TURN KNOB LAMPHOLDER

[75] Inventors: Arkady Getselis, Staten Island; Anthony Tufano, North Massapequa; Charles Chase, East Meadow, all of N.Y.; Anthony DeVincentis, Spring Hill, Fla.

[73] Assignee: Leviton Manufacturing Co., Inc., Little Neck, N.Y.

[ * ] Notice: The term of this patent shall not extend beyond the expiration date of Pat. No. 5,514,006.

[21] Appl. No.: 880,701

[22] Filed: Jun. 23, 1997

Related U.S. Application Data

[63] Continuation of Ser. No. 639,566, Apr. 29, 1996, Pat. No. 5,645,446, which is a continuation of Ser. No. 346,057, Nov. 29, 1994, Pat. No. 5,514,006, which is a continuation of Ser. No. 8,339, Feb. 9, 1993, abandoned.

[51] Int. Cl.[6] ..... H01R 33/22

[52] U.S. Cl. ..... 439/414

[58] Field of Search ..... 439/340, 409, 439/410, 414, 417, 542, 543, 658, 659, 460, 411, 412, 467, 419

[56] References Cited

U.S. PATENT DOCUMENTS

| | | | |
|---|---|---|---|
| 1,659,447 | 2/1928 | Smith | 439/467 |
| 2,411,018 | 11/1946 | Benander | 439/658 |
| 2,505,518 | 4/1950 | Benander | 200/51 |
| 4,684,195 | 8/1987 | Anderson et al. | 439/409 |

*Primary Examiner*—Neil Abrams
*Attorney, Agent, or Firm*—Paul J. Sutton, Esq.

[57] ABSTRACT

A unitary lampholder (10) including a lamp socket (12,14) as well as a multi-position switch which can take the form of a three-way, two circuit switch for operating a two filament lamp, a single circuit switch for operating a single filament lamp or arranged to permit the switch to be operated from a remote point. The lampholder has a bottom housing (14) and a top housing (12) which includes an access door (16) which is slidably and rotatably mounted to the remainder of the top housing by a guide member (54) which moves within slots (93,94) and permits the access door (16) to be rotated from a position on and perpendicular to the top housing axis to one parallel to that axis in which position it can be slidably moved towards the bottom housing. Upon slidably moving the access door towards the bottom housing, projections (160,162) on the base of access door force insulated conductors (92,94) into the insulation displacing terminals (86,88) of the contacts (60,62) to make electrical contact therewith. Other projections (154,156) securely grip the conductors to provide strain relief. A square aperture housing member (14) to accept the ends of shaped conductors (92,94) to correctly position them with respect to their terminals (86,88).

6 Claims, 7 Drawing Sheets

TURN KNOB LAMPHOLDER

This application is a continuation of application Ser. No. 08/639,566, filed on Apr. 29, 1996 and now U.S. Pat. No. 5,645,446 issued Jul. 8, 1997 which in turn is a continuation of application Ser. No. 08/346,057 filed on Nov. 29, 1994 and now U.S. Pat. No. 5,514,006 issued May 7, 1996 which is a continuation of application Ser. No. 08/008,339 filed on Feb. 9, 1993 and now abandoned.

BACKGROUND OF THE INVENTION

The present invention relates to a lampholder switch assembly which can be selectively fitted with a three way, two circuit switch for operating a two filament lamp, a single circuit on/off switch for operating a single filament lamp or provided without an internal switch for operating a single filament lamp from a remote external switch.

SUMMARY OF THE INVENTION

The lampholder of the present invention comprises a top housing member and a bottom housing member connectable to each other, with the top housing member comprised of a top housing portion and an access portion or door coupled to the top housing portion and non-separably movable with respect thereto. In a preferred embodiment shown herein, the lampholder housing is entirely plastic and can be made of any thermoplastic or thermoset material. Also in this preferred embodiment, the bottom housing member and the access door each have arcuate sections, with inner threads if necessary, at their end portions such that, when the lampholder is completely assembled, the arcuate sections face each other to form a passage for a conduit containing a pair of lamp wires which are then connected to contacts in the interior of the lampholder. The conduit may have threads on its outer surface or be unthreaded and of round, square, octagonal, hexagonal, or other cross-section with the access door and the bottom housing member being provided with suitable threads, unthreaded or configuration for accommodating any of these shapes. The access door is mounted to the top housing portion by a guide member which comprises two outwardly directed legs that fit within grooves in the top housing portion to slideably connect the access door to the top housing portion. The access door can be moved from a substantially upright position, substantially perpendicular to the longitudinal axis of the top housing portion to a position where its longitudinal axis is substantially parallel with the longitudinal axis of the top housing portion.

A captured self-tapping screw in the access door can now be advanced into a hole provided in the lower housing member. The force of the rotating screw is applied to the access door which forces each of the pair of lamp wires into insulation displacement terminals, cutting through the insulation surrounding such wires, allowing the bare wire conductors to make contact with and be held securely within the terminals. A "hot" or phase contact and a "shell" or neutral contact each have leads which contact the bare wire conductors of the lamp wires after the wires are inserted into the lampholder. The other end of the shell contact makes electrical contact with the threads of an incandescent bulb which is screwed into the opposite end of the lampholder. The second end of the phase contact makes electrical contact with a communator to selectively apply the supply voltage to one or two lamp filaments or to a single filament directly with a remote switch controlling the on/off state of the lamp. Also, the bottom housing member and access door respectively have cooperating teeth and raised ribs which, when the access door is closed, push the pair of wires into respective branch channels and hold them therein with sufficient force to replace the knot required to meet Underwriters Laboratories' standards.

A pair of eyelets or rivets connect the top housing member to the bottom housing member. The aforementioned self-tapping screw is passed through the top of the access door and tightened to finish the aforementioned insulation displacement on the insulated lamp wires from the conduit inserted into the lampholder.

The aforementioned construction results in a capability for capturing and connecting within the lampholder the aforementioned threaded conduit and insulated lamp wires from a lamp fixture or body, by simply placing the threaded conduit and wires therein within the lampholder, closing the aforementioned access door, and tightening the aforementioned single self-tapping screw to capture the access door in a closed position.

The aforementioned preferred embodiment of the lampholder of the present invention also comprises a phase contact, a center contact, a brush contact integral with a secondary contact, and a metal commutator which distributes electricity between contacts and is engageable with the aforementioned center contact, secondary contact, and phase contact. All three of these contacts are brush-type contacts.

In the aforementioned preferred embodiment of the lampholder, a selection turn knob is fitted into the outside of the bottom housing member and connects internally with a mandrel which in turn mates with a ratchet such that turning of the knob turns the mandrel which in turn turns the ratchet, which in turn orients the commutator to define which contacts are being engaged electrically. The turn knob is a circular rod with a slightly angled surface. The turn knob is recessed into the switch body preventing the internal mandrel from being seen.

In the aforementioned preferred embodiment of the invention, the outside surface of the lampholder has a configuration which is circular at the point of lamp insertion and gradually flows downward to two flat surfaces continuing further down to a smaller circular configuration. There are also a plurality of decorative depressed grooves arranged around the body surface.

In this preferred embodiment the shell contact connecting element is of one-piece construction with a wire insulation displacement type terminal forming one end of the connecting element and a shell contact forming the other end of the connecting element. The phase or line contact connecting element is also of one-piece construction with a line brush contact forming one end of the connecting element and a wire insulation displacement type terminal forming the other end.

Another advantage of the aforementioned preferred embodiment includes the severing of the conductor insulation to permit electrical contact with the central conductor which obviates the need for any stripping of the insulation from the aforementioned lamp wires which are stranded copper conductors in the aforementioned preferred embodiment. This saves labor, but more importantly, it eliminates any problems with stray strands of wire causing short circuits between the phase and neutral conductors.

Other advantages of the aforementioned preferred embodiment include the use of a square polarized insulated conductor to be inserted into a square hole behind one of the aforementioned insulation displacement terminals. Also, a round insulated conductor in inserted into a round hole behind another insulation displacement terminal. This construction including, both round and square holes, includes means for holding the wires securely in place as these leads are bent at an approximately 90 degree angle with respect to the plane across the holes, across the aforementioned insulation displacement terminals, and into a unique channel with pointed retaining ribs.

The aforementioned conduit from the lamp fixture can be threaded on its external surface to mate with threads on the interior surface of the lampholder to place it in a position ready for clamping. The conduit from the lamp fixture can have different cross-sectional shapes such as square, rectangular or octagonal shapes or be round but without external threads.

An optional conduit locking mechanism, consisting of a square, rectangular, circular or other cross-sectional shaped elastomeric material which fits into a mating recess, in either the access door or bottom housing member or in the conduit external threads in the mounting area. The elastomeric material is distorted in the threads and securely locks the lampholder in place on the conduit.

The aforementioned access door has two sets of ribs which perform two entirely different functions. One function is to force the conductors into the insulation displacing terminals of the contacts and the second is to provide strain relief for the conductors. Also, the guide member to which it is attached permits it to hold the access door in a closed position to facilitate shipping and to hold the access door in an open position when it is being wired to a lamp fixture. As discussed previously, after the wires are in position within the lampholder, the access door will be rotated through approximately 90 degrees and be moved in a downward direction until it stops when abutting the insulated conductors. The captured self-tapping screw in the access door can now be advanced into the unthreaded aperture provided in the lower housing member. The rotating screw forces the access door against the insulated conductors pushing them into respective ones of the aforementioned insulation displacement terminals which terminals cut into the insulation of the conductors allowing the bare central wire conductors to make contact with and be held securely within the terminal. In the same downward movement of the access door, the raised ribs will force the insulated conductors into individual channels. The rib and channel combination grips the insulated conductors with sufficient force to provide the desired strain relief and obviate the need for a knot such as is customarily required in lampholders by Underwriters Laboratories. At the same time, the door closing action firmly clamps the threaded conduit from the lamp fixture to the lampholder.

DESCRIPTION OF THE PREFERRED EMBODIMENTS

Figure 2:
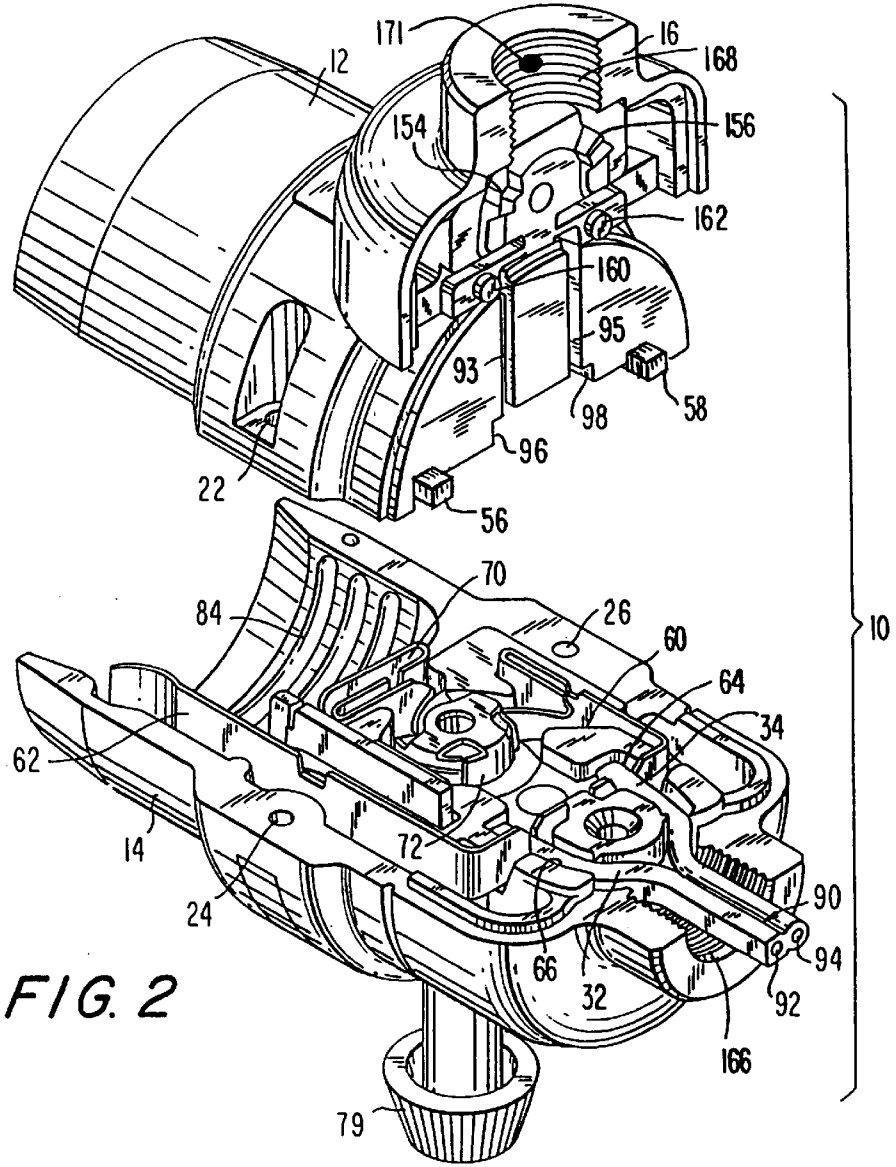
FIG. 2 is a perspective view of the housing of the lampholder of FIG. 1 with the top and bottom housings separated from each other.

Corresponding elements are identified by the same reference numerals throughout the drawings.

Figure 1:
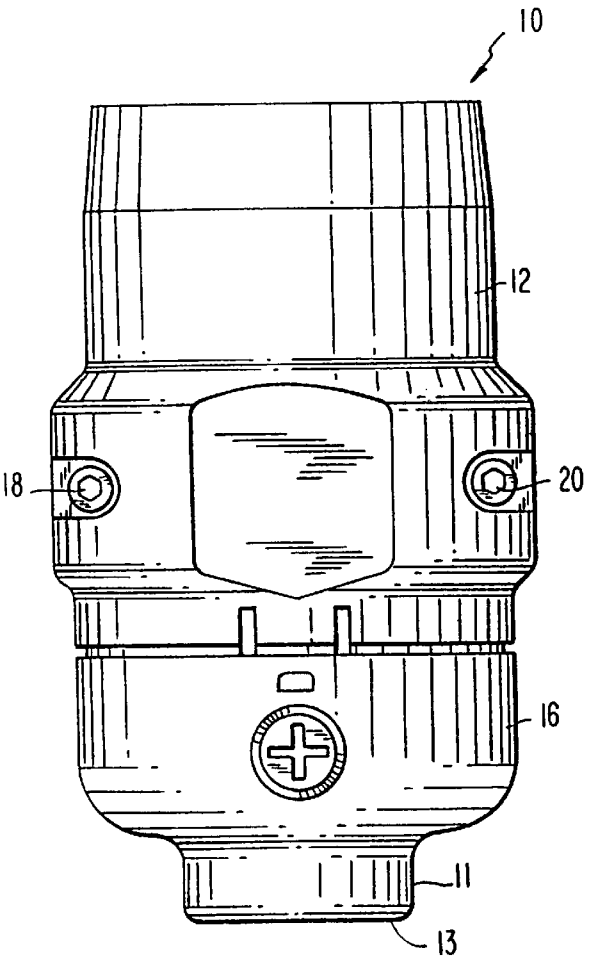
FIG. 1 is a front elevational view of a lampholder constructed in accordance with the concepts of the present invention.
Figure 3:
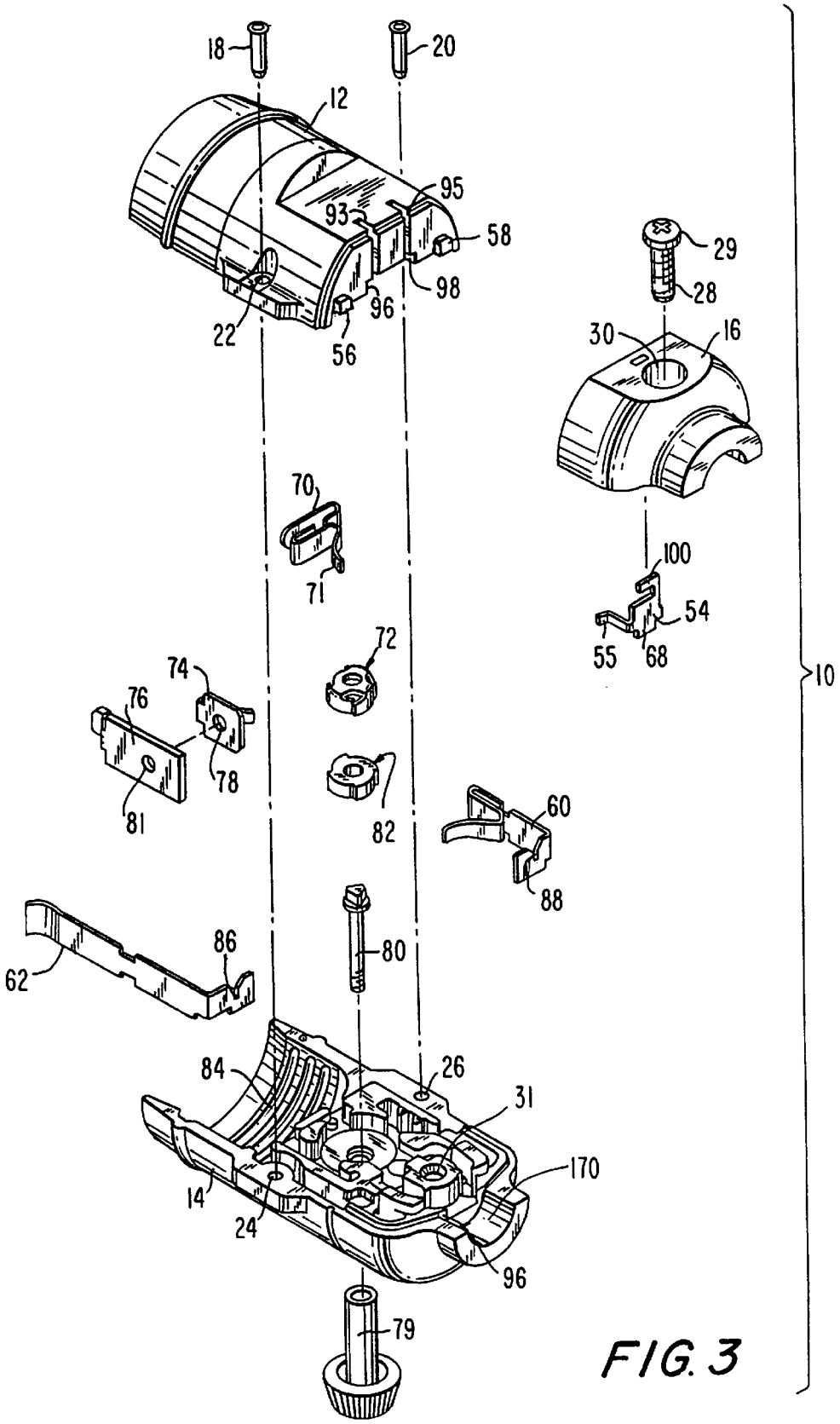
FIG. 3 is an exploded perspective view of the lampholder shown in FIGS. 1 and 2.

As shown in FIGS. 1–3, lampholder 10 comprises a top housing member 12, a bottom housing member 14 which is connected to the top housing member 12 in the assembled lampholder, and an access door 16 which is movably attached to top housing member 12 and which can be moved from an open position (FIG. 2) allowing easy placement of lamp wires within the lampholder 10 to a closed position (FIG. 1) which, with the rotation of self-tapping screw 28, into the bottom housing member 14 pulls access door 16 and bottom housing number 14 together to complete the insulation displacement of the insulated conductors by severing the insulation and allowing the terminals and the central conductors to make electrical contact, and which securely holds the conductors within lampholder 10.

As best shown in FIG. 3, a pair of eyelets or rivets 18, 20 are used to connect together top housing member 12 and bottom housing member 14. Thus, eyelet 18 is passed first through aperture 22 in top housing member 12 and then through aperture 24 in bottom housing member 14. Likewise, eyelet 20 is passed through an aperture (not shown) in top housing member 12 and then through aperture 26 in bottom housing member 14. The eyelets are then rolled over to hold the top and bottom housing members 12, and 14 together.

The self-tapping screw 28 enters access door 16 through aperture 30 and, in the completed assembly of the lampholder 10, cuts threads in the walls of aperture 31 in the bottom housing member 14, which is made of Bakelite or urea, and thus locks access door 16 to bottom housing member 14 to hold the insulation displaced insulated conductors 32, 34 (FIG. 4) securely within the lampholder 10. Screw 28 can be made of stainless steel plated with nickel and the eyelets 18 and 20 can be made of polished aluminum or steel or brass. The screw head 29 is of the type which can accommodate either a Phillips cross-type or a flat blade screwdriver.

Figure 4:
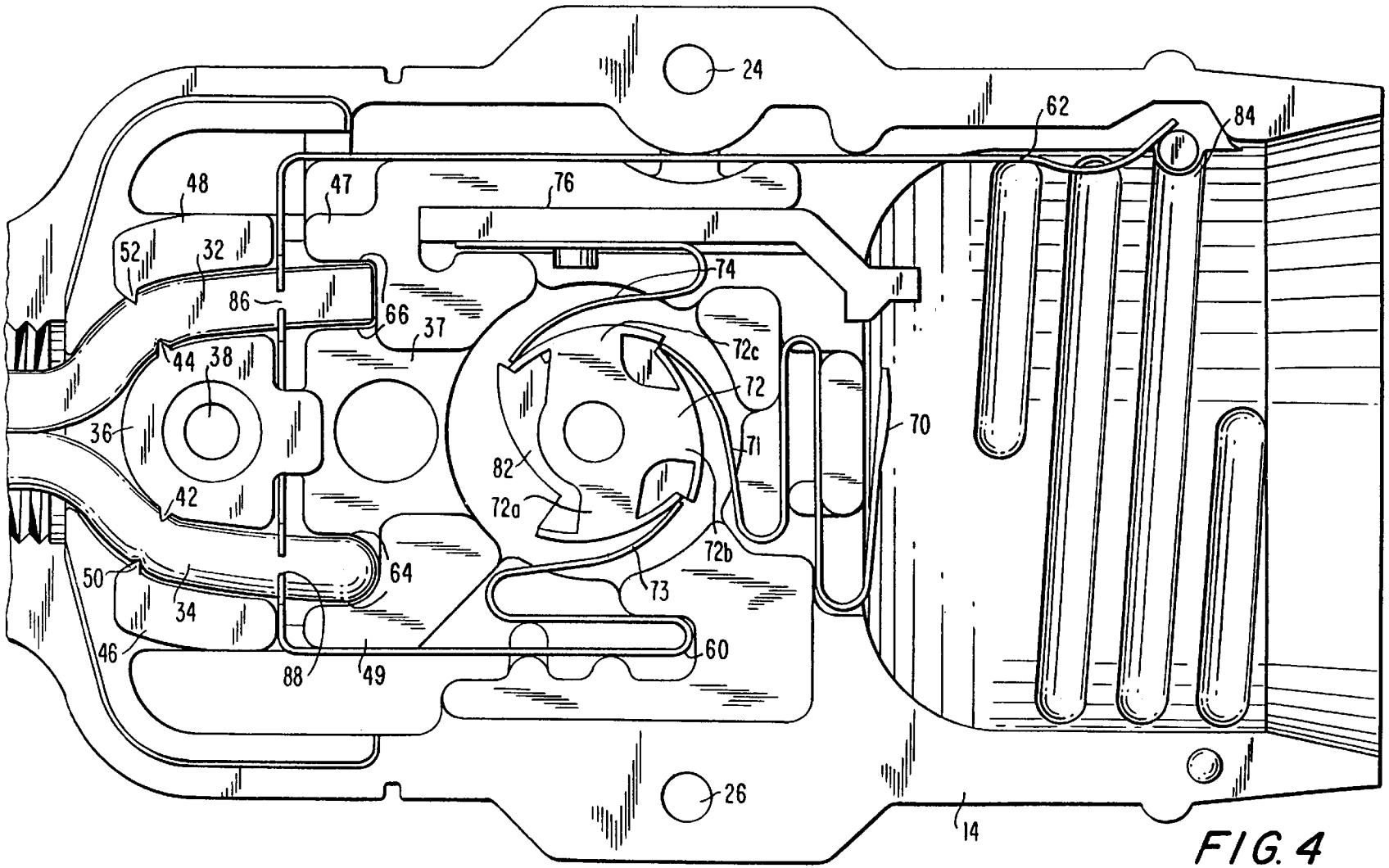
FIG. 4 is a fragmentary top plan view of the lampholder bottom housing member shown in FIGS. 1–3 with lamp wires being captured as would occur after the access door had been closed.

As shown in FIG. 4, bottom housing member 14 has an inner holding member 36 comprising a central aperture 38 into which self-tapping screw 28 is advanced forming threads as shown at 40. Inner holding member 36 may optionally have a pair of teeth 44, 42 for respectively holding in place insulated conductors 32 and 34 in branch channels 66 and 64. Corresponding outer holder members 48 and 46 in bottom housing member 14 respectively have teeth 52, 50 opposite teeth 44, 42. These teeth hold the conductors 32 and 34 in the places shown in FIG. 4 after the access door 16 is in its closed position. These teeth will retain conductors 32, 34 in their places in the event access door 16 is opened to inspect the lampholder interior. Branch channel 64 is defined by inner holding member 36 and outer holding members 46 and 49 while branch channel 66 is defined by inner holding member 36 and outer holding members 48 and 47.

As shown in FIG. 3, guide member 54 has a pair of oppositely directed legs (only leg 55 shown) which fit into grooves 93, 95 in top housing member 12 and thus slideably attach access door 16 to top housing member 12. Guide member 54 also includes a bottom tab 68.

As best shown in FIG. 4, the contact arrangement of the three way switch lampholder 10 comprises a "hot" or phase contact 60 and a neutral or "shell" contact 62 which have terminals 88, 86, respectively, to cut through and displace the insulation on insulated conductors 34 and 32 and make electrical contact with the metal conductors therein and aid in holding the insulated conductors 34 and 32 within respective channels 64, 66 of bottom housing member 14. The insulated conductors 32, 34 are respectively laid into branch channels 66, 64 and when the access door 16 (shown in FIG. 2) is closed, the raised ribs 154, 156 on the access door 16 engage the insulated conductors 32, 34, held in branch channels 66, 64 respectively, and hold them compressed in an "anvil-type" fashion between such channels 66, 64 and the raised ribs 154, 156 so as to provide sufficient strain relief so that the aforementioned U.L. knot can be omitted. Also, as shown in FIG. 2, the access door 16 has protuberances 160, 162 formed on its under surface. Protuberance 160 engages insulated conductor 32 adjacent the insulation displacing terminal 86 and when access door 16 is forced into position by assembly screw 28, protuberance 160 forces the insulated conductor 32 into terminal 86 which causes electrical contact between terminal 86 and the central metal conductor of insulated conductor 32 and thereafter retains conductor 32 in terminal 86. In a similar fashion, protuberance 162 forces insulated conductor 34 into terminal 88 so that terminal 88 is electrically connected to the central metal conductor of conductor 34 and held in place with respect thereto. As shown in FIGS. 2 and 3, the actual surfaces of the guide channels of top housing member 12, which make physical contact with and displace the insulation on wires 32 and 34, are flared (they could be chamfered) walls 96 and 98 which respectively define the lower bottom outermost walls of slots 93 and 95. Also, as shown in FIG. 3, protuberances 56 and 58 help to orient the top housing member 12 in correct alignment with access door 16. Again referring to FIG. 3, top tab 100 of guide member 54 latches into a dimple (not shown) in the plastic inner surface of access door 16 such that of guide member 54 is held in access door 16. The two legs 55 of guide member 54 slide along the grooves 93 and 95 of top housing member 12 while the oppositely, outwardly directed leg ends ride along the interior of top housing member 12 adjacent the slots 93 and 95. It should be noted that slots 93 and 95 extend into the flat region of top housing member 12.

When lampholder 10 is shipped the guide member 54 tends to keep the access door 16 closed against bottom housing member 14. To wire the lampholder 10, the access door 16 is slid up the perpendicular face of the top housing member 12 with the legs 55 of guide members 54 traveling in the grooves 93 and 95 while the oppositely, outwardly directed leg ends ride the interior of the top housing member 12 adjacent grooves 93 and 95 preventing separation of access door 16 from top housing member 12. When the leg 55 ends engage the interior surface of the flat top of top housing member 12, the access door 16 is rotated 90° with respect to the perpendicular face of the top housing member 12 to come to rest upon the flat portion of top housing member 12 as is shown in FIG. 2.

Once the insulated conductor 32 and 34 are in place, the access door 16 is rotated 90° from the position shown in FIG. 2 and the access door 16 is slid down towards the bottom housing member 14 with the legs 55 of guide member 54 following grooves 93 and 95 to prevent separation of access door 16 from top housing member 12 and to insure that access door 16 is properly aligned with bottom housing member 14. The screw 28 can now be operated to complete the assembly.

Center contact 70 is a one piece contact and brush contact that has a leg 71 that serves as a brush contact which is engageable with the commutator 72. Commutator 72 is also engageable with "hot" contact 60 through brush contact 73 and intermediate contact 76 through brush contact 74 and thus distributes the electrical input from one contact to the other. Intermediate contact 76 is integral with brush contact 74 by means of a dimple 81 from intermediate contact 76 fitted into aperture 78 in brush 74 to prevent brush 74 from floating.

Neutral or shell contact 62 bypasses commutator 72 while respective brush contacts 73,71 and 74 of contacts 60, 70, and 76 can be brought into contact with commutator 72 depending on its relative orientation. It is the orientation of commutator 72 with respect to the aforementioned brush contacts of contacts 60, 70, and 76 which determines the state of the three way switch of the lampholder 10. The position of the commutator 72 is determined by rotation of the knob 79 which rotation turns the mandrel 80 which in turn rotates the ratchet 82 made of insulating material which is in contact with commutator 72 made up of metal segments 72*a*, 72*b* and 72*c* which is turned by ratchet 82 to provide different combinations of electrical contact. FIG. 4 shows the switch in a "high" position from which it can be changed to "off" or "low" or "medium" position by rotation of commutator 72.

The high position of a two circuit switch for operating a two filament lamp is the one where both filaments are supplied with line current. Medium is the position where the higher wattage filament is connected to line current while in low the lower wattage filament is de-activated. In the off position neither filament is supplied with line current. In FIG. 4, one line, 32 is connected to the neutral or shell contract 62 which means that one end of each of the two filaments is connected to one line of the AC supply. The second line of the AC supply, line 34, is connected to hot or phase contact 60 which applies it to commutator segment 72*a* via brush contact 73. Since all segments 72*a*, 72*b* and 72*c* are part of the same overall commutator 72, current is applied via segment 72*b*, brush contact 71 to central contact 70 which is in contact with the second end of the higher wattage filament of a three-way bulb (not shown) causing this filament to light. Segment 72*c* is in contact with brush contact 74 of secondary contact 76 which is in contact with the second end of the lower wattage filament of the three way bulb (not shown) causing this filament to light.

Rotation of the commutator 72 in the counter clockwise direction brings the exposed segment of ratchet 82 into contact with brush contact 73 of hot or phase contact 60. Since the ratchet 82 is made of insulating material no current is applied to the commutator 72 and none of the bulb filaments are lit. One further step is the counter-clockwise direction brings segment 72*c* into contact with brush contact 73. Segment 72*a* is in contact with brush contact 74 of secondary contact 76 so that current is applied across the lower wattage filament corresponding to the low switch 79 setting.

The next counter-clockwise rotation of ratchet 82 causes segment 72*b* to be engaged by brush contact 73 of contact 60 and segment 72*c* to engage brush contact 71 of center contact 70 to apply current to the higher wattage filament corresponding to the medium position of the switch 79. A final counter-clockwise step brings the knob 79 to its high position with both lamp filaments lit.

Figure 7:
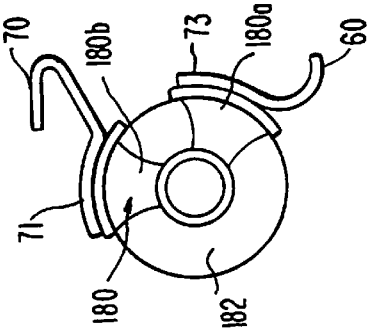
FIG. 7 is a top plan view of a modified commutator device for use with a single filament lamp.

FIG. 7 shows a modified arrangement of the commutator 180 which is used for a single circuit-on-off switch for operating a single filament lamp. The single filament of such a lamp (not shown) is connected at one end to the metal base shell and the second end is connected to the central contact or button. Thus only two contacts are necessary in the lampholder. As with the 3-way lamp discussed above, one AC supply conductor is connected to the shell or neutral contact 62 (not shown) which also contacts the lamp base shell. The other AC supply conductor is connected to hot or phase contact 60. The commutator 180 is modified to have only two segments 180*a* and 180*b*. When the ratchet 182 positions the segments 180*a* and 180*b* as shown in FIG. 7, current flows from contact 60 to brush contact 73 to the commutator segment 180*a*. This current is applied to center contact 70 via brush contact 71 and segment 180*b* which it engages. As a result current flows through the lamp filament and the lamp lights. Advancing the commutator 180 by one step of ratchet 182 puts the insulation portion of the ratchet 182 under both brush contacts 73, 71 preventing the lamp from lighting. Thus there is provided a simple on-off switch for a single filament lamp.

Figure 8:
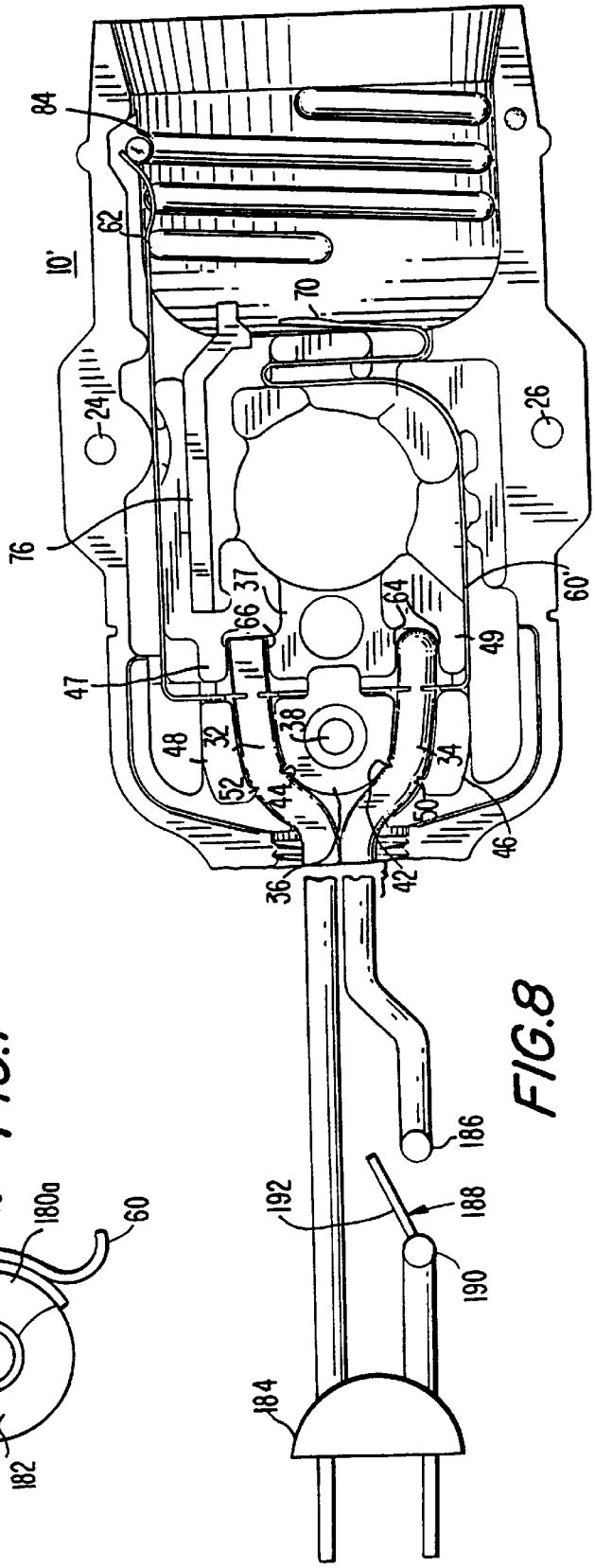
FIG. 8 is a fragmentary top plan view of the lampholder of FIG. 1 without a switch and arranged for operation with a remote switch.

To permit the lamp to be lit from a remote location, the commutator 72, ratchet 82 arrangement is omitted entirely. As shown in FIG. 8 brush contacts 73, 71 are omitted entirely and contact 60' is contacted directly to contact 70'. Conductor 32 from contact 62 is connected to one side of plug 184 which in turn is connected to an AC supply (not shown) through the usual receptacle. Conductor 34 is connected to one terminal 186 of a conventional single pole, single throw switch 188. The second terminal 190 of switch 188 is connected to plug 184. With contactor 192 in the open position as shown in FIG. 8 no current flows to the lamp in lampholder 10' and the lamp is extinguished. However, when contactor 192 is closed on terminal 186, current flows to lampholder 10' to light the lamp therein.

It should be noted that intermediate contact 76 is stationary and provides no insulation displacement on any of the wires. The insulation displacement is respectively accomplished by shell contact 62 and "hot contact" 60. Also, knob 79 can be designed in different shapes to accommodate the user's grip and for aesthetic reasons.

Top housing member 12 has inner threads (not shown in FIG. 4) which correspond to inner threads 84 of bottom housing number 14 such that a bulb can be screwed into lampholder 10 at the end opposite that of lamp insulated conductor entry.

One important advantage of the present invention is that, instead of a lampholder construction like those of the prior art wherein the switch assembly has its own socket housing which in turn is situated in the lampholder housing, the present invention has a single socket housing with the switch mechanism incorporated therein. The construction facilitates manufacture by eliminating a large percentage of parts.

Another important advantage of the lampholder of the present invention over the prior art is the insulation displacement of insulated conductors 32 and 34 by contacts 62 and 60. This occurs because, when access door 16 is closed, insulated conductors 32 and 34 are respectively forced into terminals 86 and 88 (FIG. 3) of contacts 62 and 60 by a set of raised ribs.

Yet another advantage of the present invention is that the all plastic molded housing is easily adapted for a great variety of designs by, for example, incorporating sleeves with user named logos, labeling by putting inserts into the mold prior to the molding of the housing, using extruded aluminum, brass, or stainless steel rings and knobs of various colors, etc.

As shown in FIG. 2, a threaded conduit (not shown) from the lamp fixture with wires 32, 34 therein can be placed into the molded threads 166 of bottom housing member 14 ready for clamping. The terminal slots 86 and 88 as shown in FIG. 3 are arranged to handle round insulated conductors with generally round conductors. The terminal slots can be modified and made square and round to accommodate a square polarized insulated conductor 92 and a round insulated conductor 94 when access door 16 is closed. Access door 16 also has complementary threads 168 formed therein. In addition to clamping the lampholder on the threaded conduit, the lampholder and conduit can be joined by threadedly engaging the lampholder and conduit. A locking pad 171 (see FIG. 2) of deformable elastomeric material or the like can be placed in the threads 166, 168 lock the lampholder 10 to the conduit (not shown). The pad 171 deforms to prevent the threads 166, 168 loosening with respect to the conduit. The pad 171 also takes up any initial looseness. Alternatively a set screw could be used by placing a threaded aperture transverse to the longitudinal axis of lampholder 10 in conduit entrance 11.

Figure 6C:
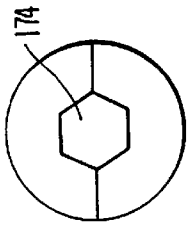
FIG. 6C is a top plan view of still another conduit entrance for the lampholder housing of FIG. 1.
Figure 6B:
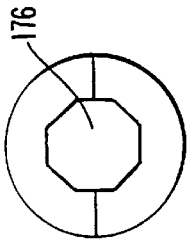
FIG. 6B is a top plan view of another conduit entrance for the lampholder housing of FIG. 1.
Figure 6A:
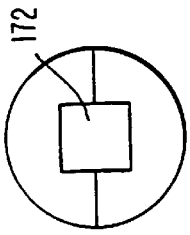
FIG. 6A is a top plan view of an alternate conduit entrance for the lampholder housing of FIG. 1.
Figure 9:
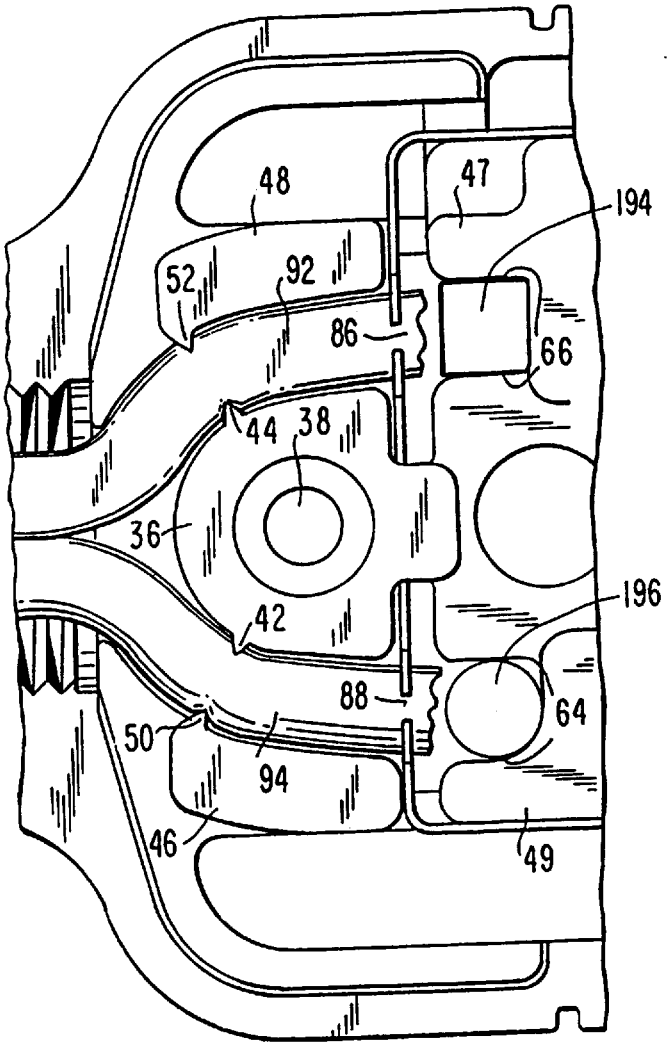
FIG. 9 is a fragmentary top plan view of the bottom housing member of FIG. 4 with a portion of the installed conductors removed to better appreciate the details of such bottom housing member.

If desired the aperture in conduit entrance 11 can be left unthreaded, that is, the interior surfaces of the bottom housing member 14 and the access door 16 that define the aperture 13 of conduit entrance 11 can be smooth and unbroken as at 170 in FIG. 3. Although not visible in FIG. 3, the inner surface of the conduit entrance portion of access door 16 would be similarly smooth and unbroken. Further, the conduit entrance aperture does not have to be circular, it can be rectangular or square as at 172 in FIG. 6A, hexagonal as at 174 in FIG. 6C or octagonal as at 176 in FIG. 6b connected to shell neutral contact 62 and the round insulated conductor 99 being connected to "hot" contact 60. In addition to altering the terminal slots 86,88 to handle square and round conductors, the channels 66 and 64 can be shaped to accommodate the respective square and round insulated conductors 92, 94. To facilitate the mounting of the insulated conductors 92, 94 in the insulation displacing terminals 86 of neutral or shell contact 62 and 88 of hot or phase contact 60, a square aperture 194 is placed below the end of branch channel 66 and a round aperture 196 is placed below the end of branch channel 66 and a round aperture 196 is placed below the end of branch channel 64. To install insulated conductor 92, a short length of insulated conductor 92 is separated from insulated conductor 94. The ends of both conductors 92 and 94 should be square cut, that is cut perpendicular to the longitudinal axis of the conductors. The end of insulated conductor 92 is then inserted into square aperture 194 which extends into the plane of the paper of FIG. 9 perpendicular to the plane of the paper. Insulated conductor 92 is then bent 90° to parallel the plane of the paper and led across terminal slot 86, along channel 66 over teeth 44, 52 to the conduit entrance 11. The end of round insulated conductor 94 is positioned in round aperture 196, then bent 90° and made to cross terminal slot 88 and continue along channel 64 over teeth 42, 50 to the conduit entrance 11. When the access door 16 is closed and screw 28 tightened, the square insulated conductor 92 will be driven into terminal slot 86, which slices through the insulation and makes contact with the central metal conductor and conductor 92 will be pushed below teeth 44, 52 which will retain conductor 92 in channel 66. At the same time round insulated conductor 94 will be driven into terminal slot 88 which will separate or displace the insulation to leave the central metal conductor in contact with contact 60 and conductor 94 will be pushed below teeth 42 and 50 to retain conductor 94 in channel 64. Thus if the access door 16 is opened to permit inspection of the conductors therein, conductors 92 and 94 will remain in their desired positions.

Figure 5A:
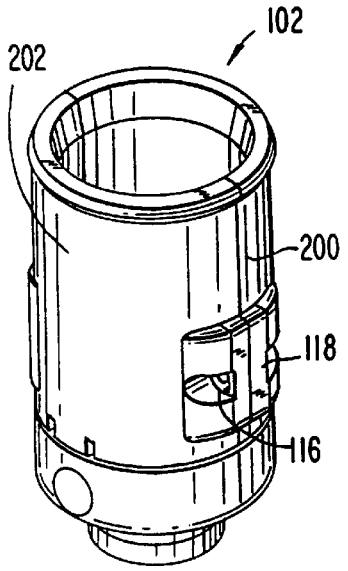
FIGS. 5A–5H show perspective views of various arrangements for the decorative ridges, grooves, flat areas, etc. which can be placed around the outside surface of the inventive lampholder.
Figure 5B:
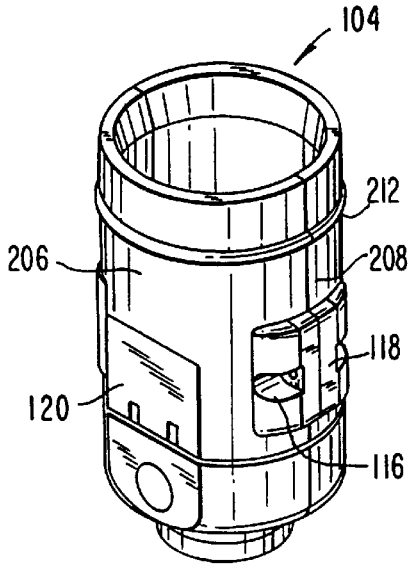

FIGS. 5A to 5H show various surface treatments of the exterior of the lampholder 10. In FIG. 5A lampholder 102 has a generally cylindrical body with built-up areas 118 on both sides (only one of which is visible in the figure). An eyelet or rivet 116, is used to assemble the two housing members 200, 202 and a raised rib 204 surrounds the housing adjacent the lamp entry. The lampholder 104 of FIG. 5B is similar to lampholder 102 except that housing members 206, 208 have flat sections 120 (only one of which is visible in the figure) and rib 212 is moved further from the lamp entry.

Figure 5C:
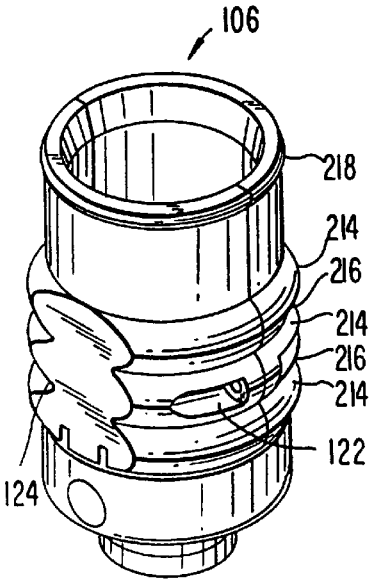

Lampholder 106 of FIG. 5C is generally circular and has a series of three raised annular rings 214 separated from each other by recesses 216. A flat 124 extends across rings 214 on both sides of the housing (only one side is visible in the figure). Recesses 122 are formed in the central ring 214 where a eyelet or rivet can be placed to assemble the housing members. A raised annular ring 218 surrounds the lamp entry.

Figure 5D:
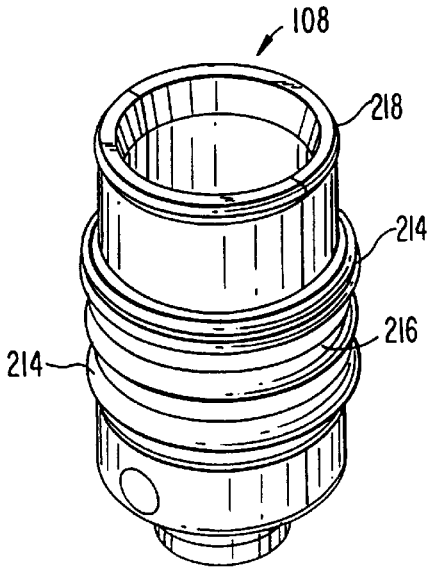

Lampholder 108 of FIG. 5D is similar to lampholder 106 of FIG. 5C but omits flats 124 and recess 122.

Figure 5E:
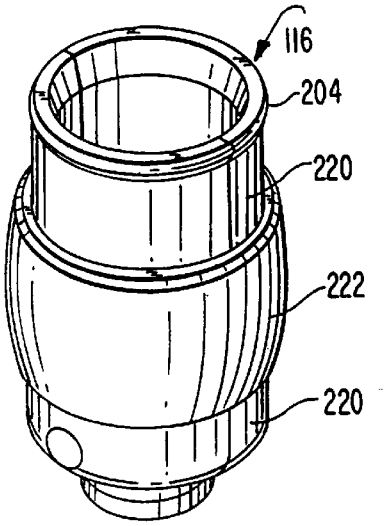

Lampholder 116 of FIG. 5E has a cylindrical body portion 220 followed by an enlarged section 222 of varying diameter being largest at the center of its length along the longitudinal axis of lampholder 116 followed by a cylindrical body portion 224 having a diameter in excess of that of body portion 220. A raised rib 204 surrounds the lamp entrance.

Figure 5F:
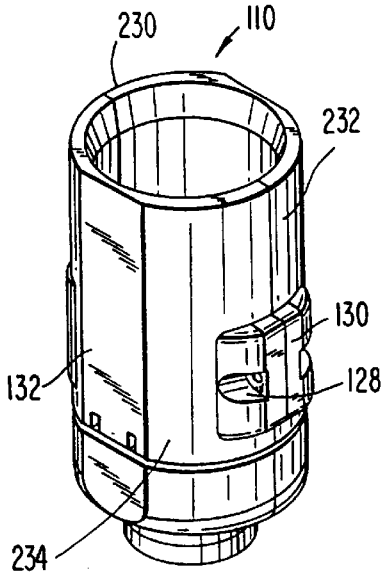
Figure 5G:
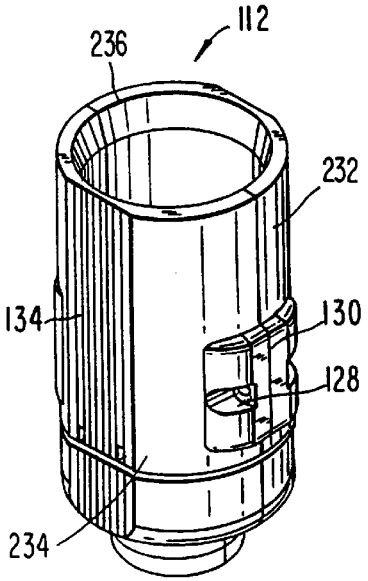
Figure 5H:
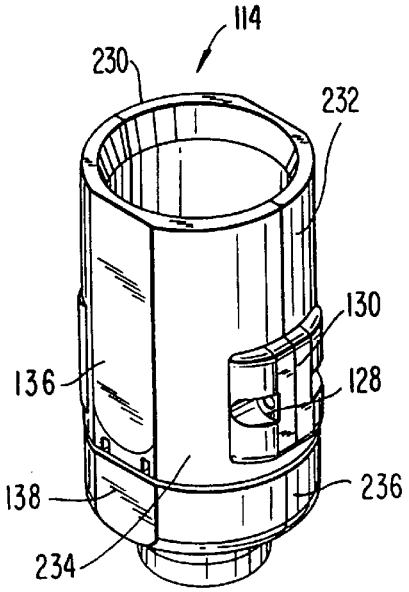

Lampholders 110, 112, and 114 of FIGS. 5F, 5G and 5H are generally similar having a uniform cylindrical body 230, with a raised portion 130 on each side (only one side is visible in the figures). An eyelet or rivet 128 on each side is used to assemble body members 232 and 234. The housing members 232, 234 of lampholder 110 have continuous flat portions 132, whereas housing members 232, 234 of lampholder 114 have interrupted flat portions, portion 136 on top housing member 232 and portion 138 on access door 236. FIG. 5G has a series of ribs 134 formed on housing members 232, 234.

The embodiments of the present invention herein described and disclosed are presented merely as examples of the invention. Other embodiments coming within the scope of the invention will readily suggest themselves to those skilled in the art and shall be deemed to come within the scope of the appended claims.

What is claimed is:

1. A lampholder having a unitary lamp socket portion and a switch portion comprising:

a) bottom housing means having conductor channels with a first end and a second end therein for accepting individual insulated conductors;

b) electrical contacts in said bottom housing means for engaging said individual insulated conductors placed in said conductor channels through said first ends;

c) top housing means having a main body portion and an access door portion, said main body portion being permanently secured to said bottom housing means having a portion of said electrical contacts and said bottom housing means exposed;

d) said access door rotatably and slideably coupled to said main body portion to permit said access door to move between a position on and perpendicular to said main body portion to a position in line with said main body portion to cover the exposed portion of said bottom housing means and said electrical contacts;

e) rotatable fastening means in said access door engageable with said bottom housing means to position said access door in intimate contact with said bottom housing means and force individual insulated conductors placed in said conductor channels to engage said electrical contacts;

f) said main body portion has a first end and a second end and said access door has a first end and a second end;

g) a flattened portion on said main body portion adjacent said first end; slots in said main body first end extending into said flattened portion of said main body portion for a first predetermined distance;

h) coupling means on said access door second end positionable in said slots to permit said access door to move along said main body first end and said flattened portion to expose and permit access to said electrical contacts; and i) said first predetermined distance of said slots limiting the movement of said access door along said flattened portion.

2. A lampholder, as defined in claim 1, further comprising:

a) stops on main body first end;

b) recesses on said second end of said access door;

c) said stops engaging said recesses to limit the closure of said access door to said bottom housing means by said rotatable fastening means to prevent injury to conductors in said conductor channels and said electrical contacts.

3. A lampholder, as defined in claim 2, wherein said stops are two projections and the number of recesses is two, one recess associated with each of said projections.

4. A lampholder, as defined in claim 1, further comprising:

a) at least one strain relief tab for each of said conductor channels on said access door to engage individual insulated conductors in said conductor channels in said bottom housing means when said access door is made to engage said bottom housing means by said rotatable fastening means.

5. A lampholder, as defined in claim 4, wherein said at least one strain relief tab is two and said strain relief tabs are triangular with a free edge to engage the insulation of individual insulated conductors.

6. A lampholder, as defined in claim 5, wherein said strain relief tabs are positioned to follow a contour of said conductor channels.

* * * * *